United States Patent [19]

Spalding et al.

[11] Patent Number: 4,836,716

[45] Date of Patent: Jun. 6, 1989

[54] METHOD AND APPARATUS FOR PILED FOUNDATION IMPROVEMENT THROUGH FREEZING USING SURFACE MOUNTED REFRIGERATION UNITS

[75] Inventors: August V. Spalding, Pinole; Mahmoud H. Sabet, Hayward; Ronald O. Hamburger, Pacifica; Martin H. Luk, Fremont, all of Calif.

[73] Assignee: Chevron Research Company, San Francisco, Calif.

[21] Appl. No.: 833,292

[22] Filed: Feb. 25, 1986

[51] Int. Cl.[4] ..... E02D 5/46

[52] U.S. Cl. ..... 405/224; 405/130; 405/225; 62/259.1

[58] Field of Search ..... 405/224, 225, 234, 217, 405/130; 62/259.1, 260; 165/45

[56] References Cited

U.S. PATENT DOCUMENTS

| | | | |
|---|---|---|---|
| 3,435,629 | 4/1969 | Hallenburg | 62/259.1 |
| 3,472,314 | 10/1969 | Balch | 62/260 |
| 3,798,912 | 3/1974 | Best et al. | 62/260 |
| 3,874,181 | 4/1975 | Pogonowski | 61/63 |
| 3,985,182 | 10/1976 | Hara et al. | 62/259.1 |
| 3,995,438 | 12/1976 | Pogonowski | 405/244 |
| 4,055,052 | 10/1977 | Metge | 62/260 |
| 4,111,258 | 9/1978 | Jahns et al. | 165/40 |
| 4,125,159 | 11/1978 | Vann | 166/285 |
| 4,195,487 | 4/1980 | Fukushima | 405/130 |
| 4,257,720 | 3/1981 | Ostgaard | 405/224 |
| 4,286,898 | 9/1981 | Stafford | 405/224 |
| 4,322,181 | 3/1982 | Streich et al. | 405/224 |
| 4,516,878 | 5/1985 | Rebhan | 405/130 |
| 4,597,444 | 7/1986 | Hutchinson | 405/130 |
| 4,632,604 | 12/1986 | McKelvy | 405/130 |

FOREIGN PATENT DOCUMENTS

| | | | |
|---|---|---|---|
| 3335511 | 4/1985 | Fed. Rep. of Germany | 405/234 |
| 617521 | 7/1978 | U.S.S.R. | 405/234 |

OTHER PUBLICATIONS

Parameswaran, "Adfreeze Strength of Model Piles in Ice", Can. Geotech. J., vol. 18, pp. 8116 (1981).

Ogata et al, "Effects of Salt Concentration on Strength and Creep Behavior of Artificially Frozen Soils", Cold Region Science & Technology, vol. 8, pp. 139–153 (1983).

Shuster, "Controlled Freezing for Temporary Ground Support", North American Rapid Excavation and Tunneling Conference, vol. 2, p. 863 (1972).

Sanger, F. J., "Formulations of Structures in Cold Regions", Cold Regions Science and Engineering, Jun. 1969.

*Primary Examiner*—Randolph A. Reese
*Assistant Examiner*—Anthony Knight
*Attorney, Agent, or Firm*—S. R. La Paglia; E. J. Keeling

[57] ABSTRACT

A method and apparatus for increasing the load bearing capacity of tubular piles by freezing an area of soil surrounding the piles. A refrigeration unit is located on the surface of an offshore structure and circulates cold brine to an isolated section of the pile. The brine freezes the soil surrounding the pile. Freezing the soil increases the surface friction beween the pile and the soil, providing increased load bearing capacity.

13 Claims, 2 Drawing Sheets

METHOD AND APPARATUS FOR PILED FOUNDATION IMPROVEMENT THROUGH FREEZING USING SURFACE MOUNTED REFRIGERATION UNITS

This application is related to U.S. Ser. No. 833,293 now U.S. Pat. No. 4,723,876.

BACKGROUND OF THE INVENTION

Frequently, large structures such as offshore platforms, are anchored to the earth with tubular piles. Those piles are inserted through structural members of the platform and driven into the earth. They are then attached or "grouted" to the structural member. Often, these piles extend several hundred feet into the earth.

The length, number and size of the pilings are in large part determined by the type of soil through which the piles are driven. Characteristics of the soil are normally determined before fabrication of the structure by analysis of soil samples or by other means. Unfortunately, soil characteristics are sometimes inaccurately predicted and after the structure is installed it is found that the as-driven piles provide inadequate support.

On other occasions, the soil qualities can be accurately determined but it may be desirable to enhance the loading capability of the piling. For example, a particularly buoyant structure such as a tension leg platform may require enhanced pull-out strength on one or more piles in soils of varying resistance properties. In still other cases, the structure is installed in permafrost and the frozen condition of the soil must be maintained to prevent settling of the structure.

Various methods of increasing or maintaining the load bearing capacity of piles have been developed. For example, "anchor bumps" can be created on the pile to increase the load carrying capacity and pull out resistance of the pile (U.S. Pat. No. 3,995,438). In some cases this may, however, not sufficiently increase the capacity of the pile.

Methods of maintaining the frozen condition of the soil have also been described (French Pat. No. 475,226, see also U.S. Pat. No. 4,111,258). These methods rely on the circulation of cold ambient air through the pile to maintain a permafrost condition. Such methods could not be applied in an area where extremely cold ambient conditions do not exist for a substantial portion of the year. Further, they provide only for maintenance of the frozen condition of soil to prevent subsidence and do not provide increased pull-out capacity.

Soil has also been frozen in order to provide temporary structural support while installing a subterranean tunnel as well as to prevent settling of a runway set in permafrost and prevent water encroachment during the installation of a ventilation shaft (Braun, B., and Nash, W. R., "Ground Freezing for Construction," *Civil Engineering,* January, 1985, pp. 54–56). In none of these situations is a long-term method of substantially increasing the load bearing and pull-out capacity of a tubular pile provided.

In summary, it is clear that an improved method of substantially enhancing the load bearing and pull-out capacity of piles is desirable.

BRIEF DESCRIPTION OF THE PREFERRED EMBODIMENT

The present invention provides a means and method for increasing the capacity of tubular piles by freezing one or more areas of soil surrounding the piles. The invention would be used where a tubular pile, whose design capacity was to be provided through shaft friction, is incapable of supporting design loads because adequate shaft friction cannot be developed or where the frozen condition of soil must be maintained to prevent settling.

The preferred embodiment features single refrigeration plant located on the deck of an offshore platform. Concentrated brine or another secondary refrigerant is cooled by the refrigeration plant to approximately −20° C.

The chilled brine is distributed to each of the piles under the structure and is released at the bottom of the pile in a brine reservoir defined on the top by an insulating barrier and on the bottom by a concrete plug. The surrounding soil warms the brine and the warm brine rises to the top of the brine bath. The warm brine enters a return line, is returned to the refrigeration unit, chilled, and recirculated.

The chilled brine cools and eventually freezes the soil surrounding the in-situ pore water surrounding the pile and eventually the adjacent soil sediments, thus forming a large frozen soil mass.

The net result is that the pile has greatly increased capacity against downward and pull-out load applications. The major components contributing to this increased capacity are the increased side friction and end bearing between the frozen and unfrozen soil masses, both being transferred through the induced adfreeze bond between the steel pile and surrounding soil. The increased adhesive friction between the shaft and the pile, combined with the increased end bearing capacity of the frozen mass significantly enhance the capacity of the pile.

OBJECTS OF THE INVENTION

It is the particular object of the invention to provide an apparatus and method of increasing the load bearing capacity of a tubular pile by freezing and/or maintaining the frozen condition of soil in an area surrounding the pile. It is a further object of the invention to provide an apparatus and method by which the soil surrounding a pile can be frozen and/or maintained in a frozen condition. Additional objects and advantages of the present invention will become apparent from reading the following detailed description in view of the accompanying drawings which are made part of this specification.

DETAILED DESCRIPTION OF THE PREFERRED EMBODIMENT

Figure 1A:
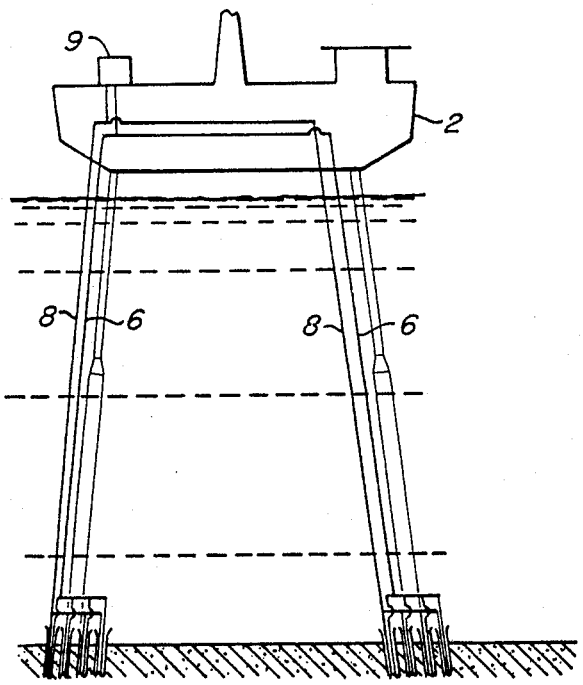
FIG. 1*a* is a schematic view of the pile freezing system, above the ocean floor.
Figure 1B:
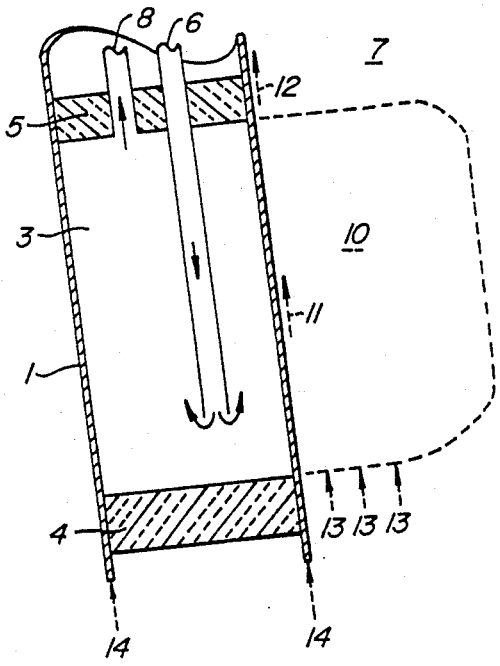
FIG. 1*b* is a cross section of the section of pile to be frozen.

FIGS. 1*a* and 1*b* illustrates the concept of pile freezing as a method of increasing the load bearing capacity of the pile on an offshore platform. A section of tubular pile 1 which supports an offshore platform 2 is filled with a solution of brine 3 or other secondary refrigerant above a concrete plug 4. In the preferred embodiment the secondary refrigerant 3 is an aqueous solution of calcium chloride. Various secondary refrigerants are well-known in the art.

The top of the brine filled section of pile is isolated from the upper portion of the pile with an insulating barrier 5. Cold brine from a central refrigeration plant 9 is supplied through a cold brine supply lines 6 through which brine at approximately −20° to −30° C. is pumped to the individual piles 1.

As cold brine is pumped (pump not shown) into the pile through the brine supply line, heat is transferred from the surrounding, warmer, unfrozen ground 7 to the cold brine. The brine migrates upward through the pile until it reaches the brine return line 8 and is returned to the surface of the platform after being combined with refrigerant return lines from other piles. The combined warm brine is returned to the refrigeration system 9. The refrigeration system rechills the brine and returns it to the pile through the brine supply lines 6.

Both the brine supply lines 6 and the brine return lines are insulated. They are positioned using jacket pile installation guides (not shown). To maintain a tight seal around the supply and return lines and the insulation barrier, seal units (not shown) are utilized. The seal units also allow for easy retrieval of the lines when necessary. Shut-off valves may also be provided to facilitate carrier line retrieval or repair.

As heat is transferred from the surrounding soil to the brine, the soil cools and the pore water contained within the soil freezes. Eventually, a large frozen mass of soil surrounding the pile is formed 10. Adhesive friction between the tubular pile and the frozen soil (depicted by arrow 11) is significantly greater than shaft friction between the pile and unfrozen soil (depicted by arrow 12). Provided adfreeze strength between the tubular pile and frozen soil is sufficiently strong to transfer loading, the frozen mass surrounding the pile provides increased support because: (1) Side friction area available to transfer loading into the native unfrozen soil mass is much greater than that available without freezing, thus allowing increased support capability; and (2) End bearing area formed due to the freezing process forms an additional support component (depicted by arrows 13) contributing to increased foundation capacity over that provided by the pile alone (depicted by arrows 14).

Figure 2:
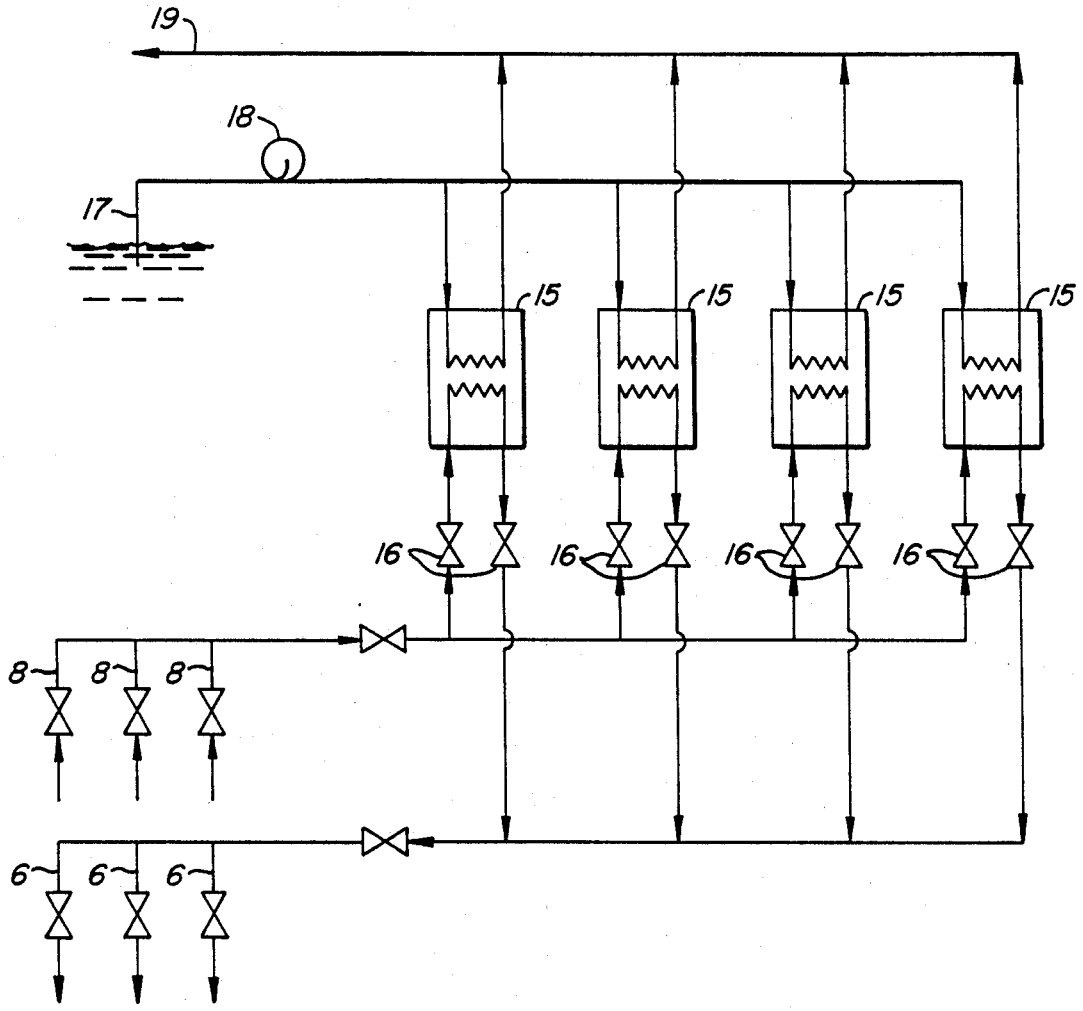
FIG. 2 is a flow diagram showing the process by which cold brine is chilled and circulated to the various piles on an offshore platform.

FIG. 2 graphically depicts the manner in which the brine solution is chilled. Common elements of FIG. 1 are numbered identically. Warm brine is returned to the deck through the brine return lines 8 at approximately −24° C. in the preferred embodiment. The warm brine is cooled in a plurality of commercially available packaged refrigeration units 15. Brine is chilled to approximately −28° C. in the refrigeration units in the preferred embodiment. The temperature to which the brine is chilled will depend on factors such as the necessary adfreeze strength needed, soil property variations with temperature and other factors which will vary from location to location. The chilled brine is returned to the piles in the brine supply lines 6. Each of the refrigeration units and brine lines can be isolated with isolation valves 16.

Compressor cooling and condensor cooling in the refrigeration unit is provided with seawater, from a seawater supply line 17. This seawater is circulated with a pump 18 and is passed through heat exchangers within the refrigeration units. Warmed seawater is returned to the ocean through a seawater disposal line 19.

It should be noted that while seawater is used as a refrigeration system cooling media in the preferred embodiment, other cooling media could be utilized. For example, air exchangers might be used. Alternatively, a single seawater exchanger could be used to cool a circulating fresh water system. All of those technologies are readily known to one skilled in the art.

Multiple compressor/expander units are desirable since the refrigeration plant demand will change with time, i.e., greater refrigeration capacity is required to cool the brine bath from its initial temperature to its operating temperature and freeze the surrounding soil than is required to maintain the soil in its frozen condition. By using a multiple compressor refrigeration plant, compressors can be turned off as necessary to reduce refrigeration capacity from its initial high requirement to the later low requirements and back-up capacity is provided.

Since many modifications and variations of the present invention are possible within the spirit of the disclosure, it is intended that the embodiments disclosed are only illustrative and not restrictive. For that reason, reference is made to the following claims rather than the specific description to indicate the scope of the invention.

What is claimed is:

1. An offshore platform anchored to the seafloor by at least one tubular pile which seafloor is incapable of supporting design loads comprising:

a. an offshore structure connected to the seafloor by at least one tubular pile;

b. a plug contained within said tubular pile, said tubular pile being initially inserted into unfrozen ground, said plug located generally near the bottom of said pile;

c. an insulating divider closing off said tubular pile, above said plug, such that said divider defines the top of a cylindrical reservoir, the bottom of which is defined by said plug and the sides of which are defined by said tubular pile;

d. cooling fluid filling said reservoir;

e. means for cooling said cooling fluid to a temperature of −20° C. to −30° C. whereby a frozen mass of soil is formed around said tubular pile, said means for cooling said cooling fluid further comprising a compressor/expander combination, said compressor/expander combination located on a deck of said offshore structure supported by said tubular pile;

f. an insulated cold conduit means tubularly connecting said reservoir and said compressor/expander;

g. an insulated warm conduit means extending from said reservoir to said compressor/expander combination for fluid flow; and h. a pump for circulating said cooling fluid there between through said cold conduit and said warm conduit means.

2. Apparatus as recited in claim 1 wherein said cooling fluid is circulated to a plurality of piles.

3. The apparatus of claim 1 wherein said cooling fluid is a solution of calcium chloride in water.

4. The apparatus as recited in claim 1 wherein said pile is a driven pile.

5. A method of increasing the design load capacity of an offshore platform anchored to the seafloor by at least one tubular pile which seafloor is incapable of supporting design load which comprises:

a. isolating a section of a tubular pile on the bottom with a bottom plug and on the top with an upper insulating divider, said tubular pile inserted into previously unfrozen ground;

b. pumping a cooling fluid at a temperature of −20° C. to −30° C. in said isolated section whereby the surrounding soil is frozen, said cooling fluid cooled in a compressor/expander refrigeration unit located on a deck of an offshore structure.

6. The method of claim 5 wherein said cooling fluid is circulated to a plurality of piles from said compressor-/expander refrigeration unit.

7. The method of claim 5 wherein said cooling fluid is an aqueous solution of calcium chloride.

8. Apparatus for increasing the load bearing capacity of piles which are incapable of supporting design loads in an offshore platform comprising:

a. a plug contained within a pile of an offshore platform said pile inserted into normally unfrozen ground;

b. an insulating divider isolating said tubular piles above said plug, such that said divider defines the top of a cylindrical reservoir, a bottom of which is defined by said plugs and a side of which is defined by a wall of said piles;

c. cooling fluid filling said reservoir;

d. a compressor/expander refrigerator located at the top of said platform for cooling said cooling fluid to −20° C. to −30° C. whereby a frozen mass of soil is created;

e. cold conduit means tubularly connecting said refrigerator and said reservoir;

f. warm conduit means tubularly connecting said refrigerator and said reservoir; and g. a pump for circulating said cooling fluid through said cold and warm conduit means.

9. Apparatus as recited in claim 8 wherein said refrigerator contains several compressors whereby a refrigerator output can be readily varied.

10. Apparatus as recited in claim 8 wherein said cooling fluid is an aqueous solution of calcium chloride.

11. A method of increasing the support capacity of tubular pile which is found to be incapable of supporting design loads in an offshore platform which comprises:

a. isolating a section of a pile of an offshore platform with an upper insulating divider and a bottom plug whereby a reservoir is defined within said pile, said pile inserted into unfrozen ground;

b. pumping a cooling fluid to said reservoir; and c. cooling said cooling fluid with a refrigeration unit to −20° C. to −30° C.

12. The method as recited in claim 11 wherein said cooling fluid is an aqueous solution of calcium chloride.

13. The method as recited in claim 11 wherein said pile is a driven pile.

* * * * *